US006425506B1

(12) United States Patent
Wu

(10) Patent No.: US 6,425,506 B1
(45) Date of Patent: Jul. 30, 2002

(54) DECORATIVE COSMETIC CASE

(75) Inventor: Shang-Wu Wu, Tainan (TW)

(73) Assignee: Hong-Yi Cosmetics Co., LTD, Tainan (TW)

( * ) Notice: Subject to any disclaimer, the term of this patent is extended or adjusted under 35 U.S.C. 154(b) by 49 days.

(21) Appl. No.: 09/717,490

(22) Filed: Nov. 20, 2000

(51) Int. Cl.[7] ..... A45F 3/14

(52) U.S. Cl. ..... 224/219; 224/600; D28/82; 132/293

(58) Field of Search ..... 224/165, 600, 224/219, 221, 222; D28/78, 79, 82; 132/293, 294, 295, 297

(56) References Cited

U.S. PATENT DOCUMENTS 1,281,605 A * 10/1918 Lloyd ..... 224/219
1,485,915 A * 3/1924 Hammel ..... 132/293
1,607,985 A * 11/1926 Johnson ..... 132/297
1,609,481 A * 12/1926 McCarthy et al. ..... 131/241
1,623,994 A * 4/1927 Buchsbaum et al. ..... 122/58 R
1,644,404 A * 10/1927 Squier ..... 132/304
1,670,720 A * 5/1928 Gross ..... 132/286
1,714,732 A * 5/1929 Schneider ..... 132/295
1,777,027 A * 9/1930 D'Arlet ..... 132/297
1,782,024 A * 11/1930 Aronson ..... 132/297
1,861,644 A * 6/1932 Roberts ..... 132/316
D278,558 S * 4/1985 Shenken et al. ..... D28/64.2
D314,842 S * 2/1991 Fleming ..... D28/79

* cited by examiner

*Primary Examiner*—Stephen K. Cronin
(74) *Attorney, Agent, or Firm*—Pro-Techtor International Services

(57) ABSTRACT

A decorative cosmetic case includes a container and a cover member pivotally connected to the bottom of the container. The container has a semi-spherical shell with a recessed interior for storing cosmetics, and an annular projection defines the annular edge of a downward opening of the container. The cover member fits with the annular projection of the container by means of pivoting at one end and by inserting at the other end to facilitate the cosmetic case to be opened or closed. Then, a U-shaped plate is provided under the cover member, having a gap formed between the plate and the cover member for a watch belt to pass through to let the cosmetic case worn on a user's wrist, enabling the user easily pick out the cosmetics, and acquiring a decorative effectiveness as well.

8 Claims, 5 Drawing Sheets

DECORATIVE COSMETIC CASE

BACKGROUND OF THE INVENTION

This invention relates to a decorative cosmetic case particularly to one possible to combine with various accessories to be worn on a user's wrist or neck to acquire an effectiveness of convenience and decoration.

A conventional way for storing cosmetics is to put a lipstick in a tubular container, and a powder cake, an eye shadow cream, a cheek cream and the like in a container, and then, for the convenience of carrying, all these cosmetics are generally put into a cosmetic sack, which is then placed in a hand bag. In this case, a user who wants to make up with the cosmetics in the bag usually finds it not easy to quickly pick out an exact cosmetics she needs, thus wasting much time, and sometimes dropping all cosmetics down to the ground, making herself embarrassed.

SUMMARY OF THE INVENTION

The objective of the invention is to offer a decorative cosmetic case with various accessories, possible to be worn on a wrist or on the neck, not only letting a user pick out and use the cosmetics easily and conveniently, but also achieving a decorative and contrasting effect by matching a user's costume.

The feature of the invention is a container pivotally connected with a cover member having a U-shaped plate formed under the bottom.

The container is a semi-spherical shell having a downward opening with its edge defined by an annular projection, and a recessed interior for storing cosmetics. The cover member fits with the annular projection of the container by means of pivoting at one end, and by inserting at the other end to let the container opened or closed conveniently. Besides, a U-shaped plate formed under the cover member, and a gap is formed between the cover member and the U-shaped plate for a watch belt to pass through so as to let the cosmetic case easily worn on a user's wrist to facilitate usage of the cosmetics stored in the case, and to achieve a decorative effectiveness as well.

BRIEF DESCRIPTION OF DRAWINGS

The invention will be better understood by referring to the accompanying drawings, wherein.

DETAILED DESCRIPTION OF THE PREFERRED EMBODIMENT

Figure 1:
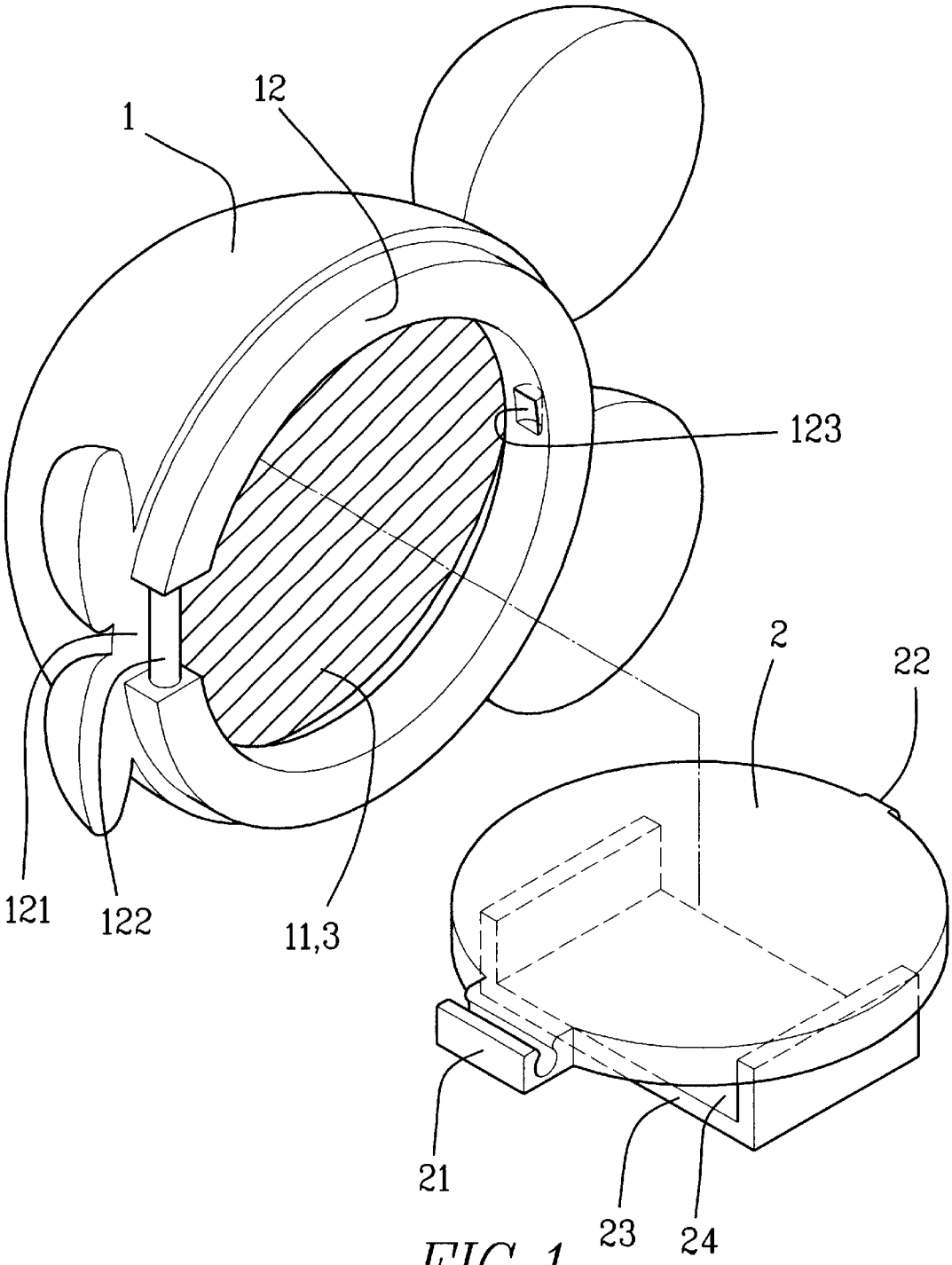
FIG. 1 is an exploded perspective view of a first embodiment of a decorative cosmetic case in the present invention.

A first embodiment of a decorative cosmetic case in the present invention, as shown in FIG. 1, includes a container 1 for storing cosmetics 3 and a cover member 2 pivotally connected to the bottom of the container 1 as main components assembled together.

Figure 2:
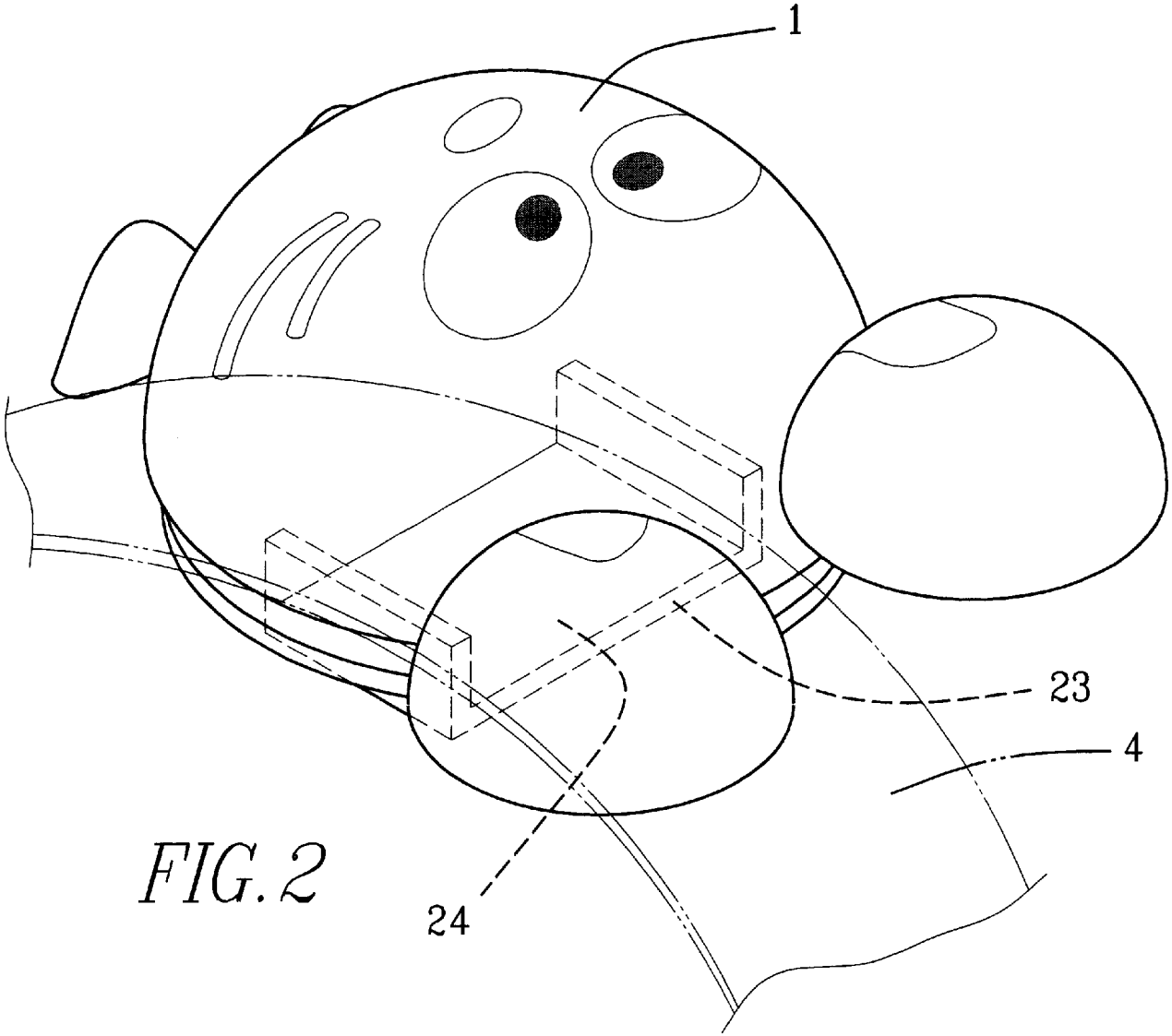
FIG. 2 is a perspective view of the first embodiment of a decorative cosmetic case in the present invention.

The container 1 is a semi-spherical shell with a downward opening and a recessed interior 11 for storing cosmetics such as lipstick, lip-protecting cream, eye-shadow cream and the like. Further, the container is made of transparent material for cosmetics stored therein to be seen from outside, and specially designed to have interesting shapes of cute animals, pretty flowers and the like, as shown in FIG. 2 illustrating a cute animal. Besides, an annular projection 12 defines the annular edge of the bottom opening of the container 1, having a gap 121 formed at one end with a pivotal upright shaft 122 fixed therein, and an inner recess 123 formed on the inner wall of the other end.

The cover member 2 is to fit with the annular projection 12 of the container 1, having a hook member 21 fixed protruding out from one end, and an inserting lug 22 formed at the other end respectively to engage with corresponding pivotal shaft 122 and an inner recess 123 of the container 1. In addition, a U-shaped lateral beam 23 formed integral is fixed under the cover member 2 in a direction of vertical intersection with a connecting line between the hook member 21 and the insert lug 22, and a gap 24 is formed between the lateral beam 23 and the bottom of the cover member 2.

Figure 3:
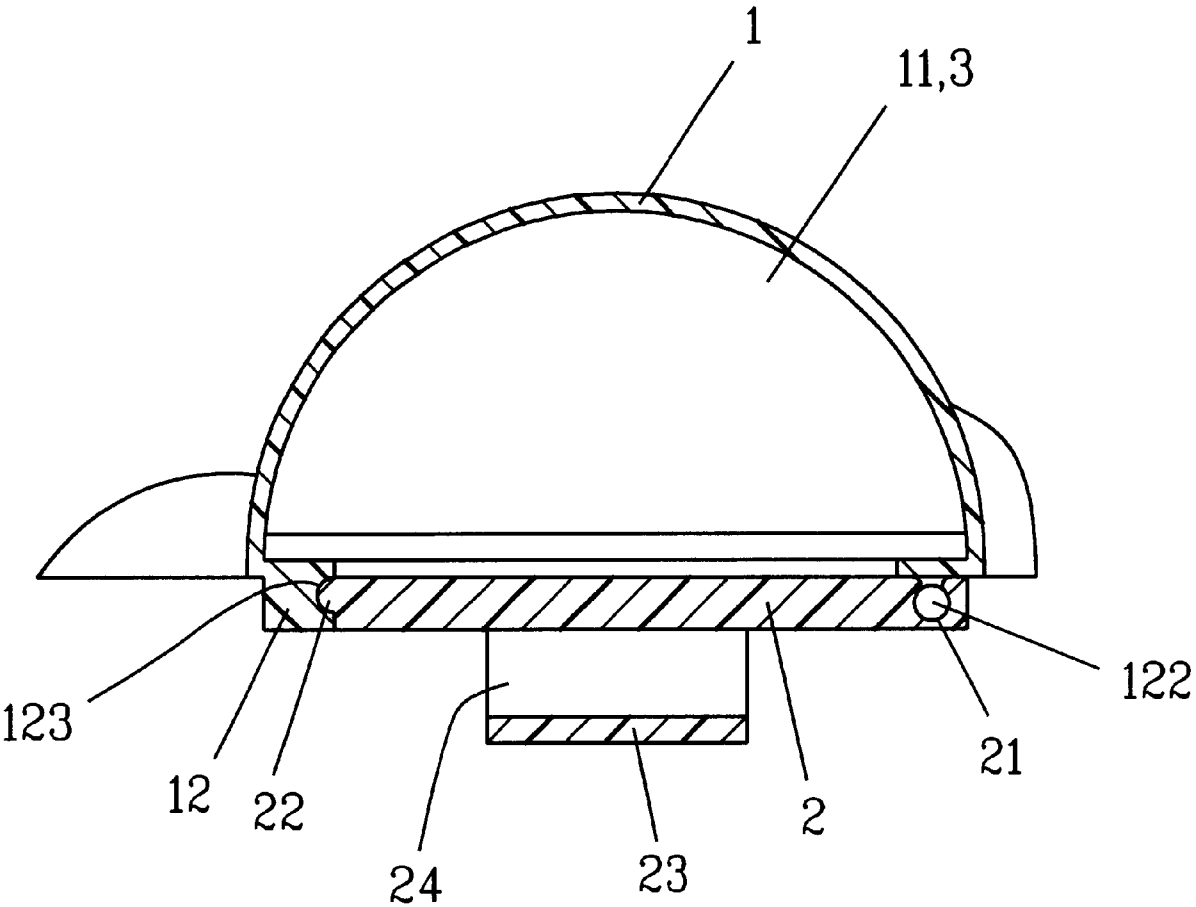
FIG. 3 is a cross-sectional view of the first embodiment of a decorative cosmetic case in the present invention.
Figure 4:
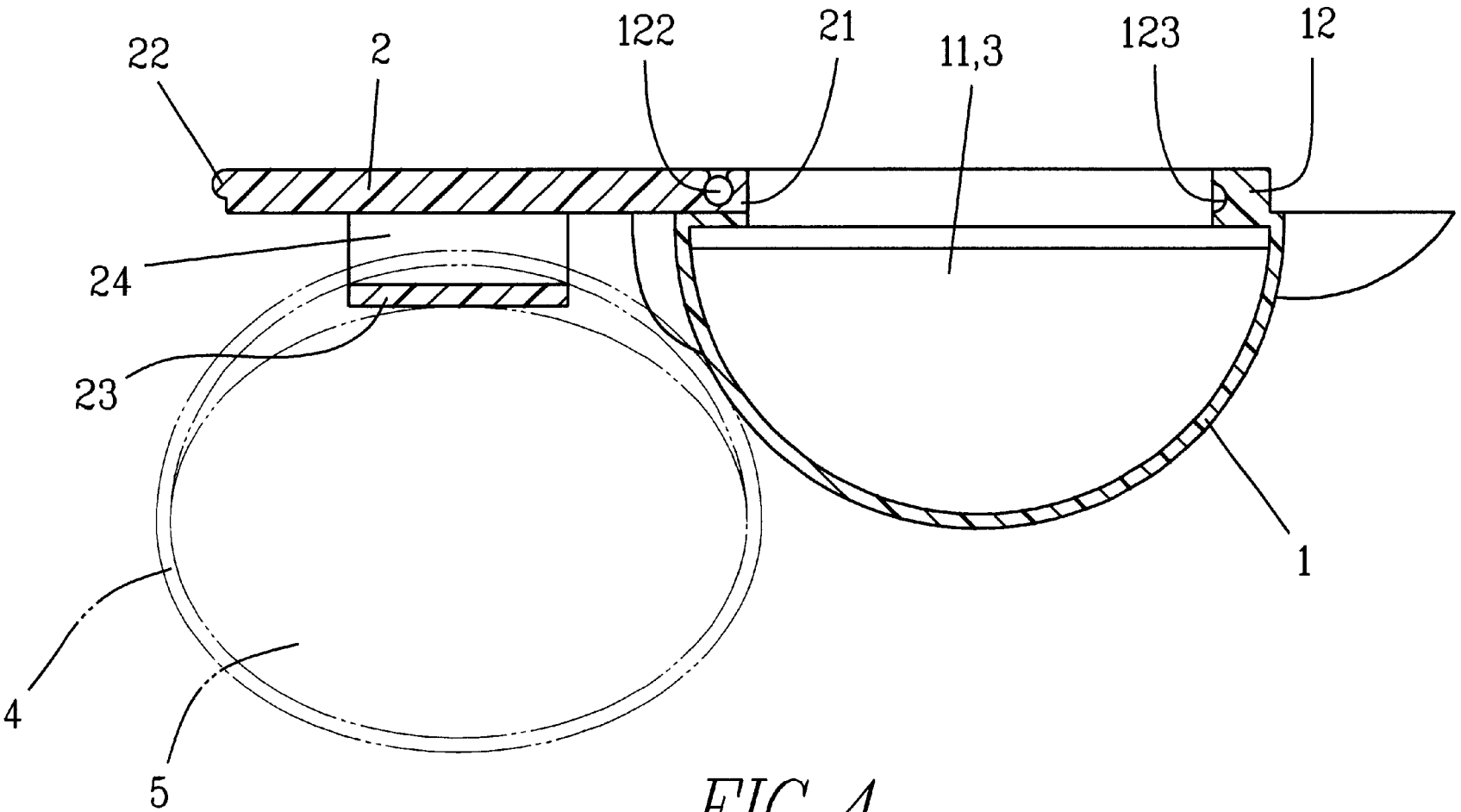
FIG. 4 is a cross-sectional view of the first embodiment of a decorative cosmetic case with its cover member opened in the present invention.

In assembling, as shown in FIGS. 2 and 3, the hook member 21 of the cover member 2 is inserted into the gap 121 to clasp the pivotal shaft 122 therein to let the container 1 pivotally rotate with the shaft 122 as a pivot. When the container 1 rotates toward with the annular projection 12 fitting in the cover member 2, the insert lug 22 of the cover member 2 will insert into the inner recess 123 of the annular projection 12, forming an integral cosmetic case. Then, a watch belt 4 is made to pass through the gap 24, forming a watch-like cosmetic case worn on a user's wrist.

When a user wearing such a cosmetic case on the wrist opens the container 1, the pivotal shaft 122 and the hook member 21 function as a fulcrum, and the inner recess 123 of the annular projection 12 and the insert lug 22 of the cover member 2 will disengage to let the cosmetic case open for the user to get the exact cosmetics she needs, thus, achieving a convenient and decorative effect.

Figure 5:
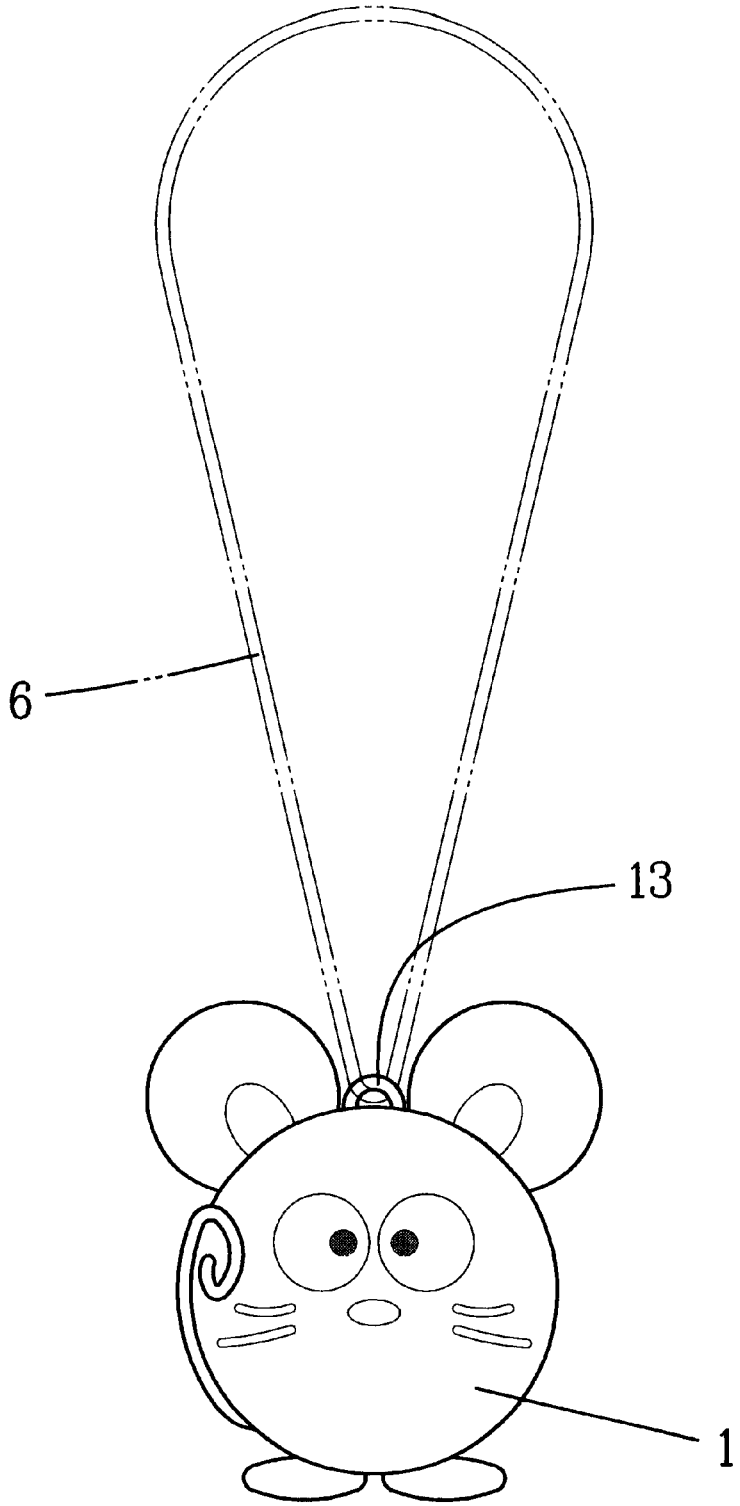
FIG. 5 is a front view of a second embodiment of a decorative cosmetic case with a ring formed integral on the top edge of the container in the present invention.

A second embodiment of a decorative cosmetic case in the present invention, as shown in FIG. 5, is provided integral with a ring 13 on the top edge of the container 1 for a string or a necklace to pass through to form a necklace with a cosmetic case for a user to wear around the neck, also achieving an effectiveness of convenience and decoration.

As can be known from the above description, a user has two alternative ways of wearing the decorative cosmetic case, either on a wrist or around the neck, synchronously acquiring a convenient and decorative effect. Besides, the transparent container 1 permits the colors of the cosmetics stored therein visible from outside so that a user can pick out the proper colored cosmetics to correspond to those of the her dress to obtain an effect of integral beauty. In addition, a user can wear both a watch and a necklace with a cosmetic case at the same time not only to acquire a contrasting effect, but also to let the user pick out and use the cosmetics easily and conveniently. Furthermore, the cosmetic case in the present invention can also be used alone without any belt or chain.

To sum up, the present invention is a combination of a cosmetic case and a decoration, elegantly designed in an outer shape to be worn on a user's wrist or neck, and easy and convenient for a user to get and use the cosmetics in the case.

While the preferred embodiments of the invention have been described, it will be recognized and understood that various modifications may made therein and the appended claims are intended to cover all such modifications that may fall within the spirit and scope of the invention.

I claim:

1. A decorative cosmetics box comprising:

A container for storing cosmetics having a downward opening, a recessed interior and an annular projection defining the annular edge of said downward opening of said container:

A cover member pivotally connected to a bottom of said container and fitting with said annular projection of said container by means of pivoting at one end and by inserting at the other to let said cover member open or close easily said downward opening of said container: and, A U-shaped plate formed under said cover member, and a gap formed between said plate and said cover member for a watch belt to pass through to facilitate said cosmetic case worn on a user's wrist with convenience of taking out the cosmetics in said container and decorative effect.

2. The decorative cosmetic case as claimed in claim 1, wherein said annular projection of said container has a gap and a recess respectively bored in two opposite ends of said annular projection of said container, and a pivotal upright shaft disposed in said gap; a hook member and an insert lug are respectively provided at two opposite ends of said cover member to correspondingly engaging with said gap and said recess of said annular projection.

3. The decorative cosmetic case as claimed in claim 1, wherein the direction of said U-shaped plate intersects vertically a connecting line between said hook member and said inserting lug.

4. The decorative cosmetic case as claimed in claim 1, wherein a Velcro belt is used instead of said watch belt.

5. The decorative cosmetics box as claimed in claim 1, wherein a ring is fixed on the top edge of said container for connecting a string to hang around a user's neck.

6. The decorative cosmetics box as claimed in claim 1, wherein a ring is fixed on the top edge of said container for connecting a necklace to hang around a user's necks.

7. The decorative cosmetic case as claimed in claim 1, wherein an outer shape of said container is specially designed with beautiful shapes.

8. The decorative cosmetics box as claimed in claim 1, wherein said container is made of transparent material to permit the colors of the cosmetics in said container visible from outside.

* * * * *